United States Patent [19]

Monticolombi et al.

[11] Patent Number: 4,805,910

[45] Date of Patent: Feb. 21, 1989

[54] MAZE PUZZLE

[75] Inventors: Carlo G. Monticolombi, Isleworth; James M. Norris, London, both of England

[73] Assignee: Carlo Geoffrey Richard Monticolombi, Isleworth, England

[21] Appl. No.: 106,063

[22] Filed: Oct. 7, 1987

[30] Foreign Application Priority Data

Sep. 29, 1987 [GB] United Kingdom ..... 8722828

[51] Int. Cl.[4] ..... A63F 9/08

[52] U.S. Cl. ..... 273/153 R

[58] Field of Search ..... 273/153 R, 156

[56] References Cited

U.S. PATENT DOCUMENTS

| | | | |
|---|---|---|---|
| D. 283,523 | 4/1986 | Balint | 273/153 R X |
| 426,569 | 4/1890 | O'Shaughnessy | 273/153 R |
| 2,001,067 | 5/1935 | Lane | 273/153 R |
| 3,819,187 | 6/1974 | Downs | 273/156 |
| 3,824,815 | 7/1974 | Darling | 273/156 X |

FOREIGN PATENT DOCUMENTS

| | | | |
|---|---|---|---|
| 63816 | 11/1982 | European Pat. Off. | 273/153 R |
| 426585 | 4/1935 | United Kingdom | 273/153 R |
| 2074460 | 11/1981 | United Kingdom | 273/153 R |

*Primary Examiner*—Anton O. Oechsle

*Attorney, Agent, or Firm*—Parmelee, Miller, Welsh & Kratz

[57] ABSTRACT

A toy or plaything in the form of a puzzle comprises a first member, and a second member constituting a housing within which the first member is rotatably mounted. The second member is such that access is provided to the first member to enable manual rotation thereof. A peg is mounted on one of said members and a maze is defined in a surface of the other of the first and second members, the peg engaging the maze such that upon selectively rotating the first member within the second member the peg is caused to move through the maze. There is further provided means to indicate when the peg is at a predetermined destination in the maze.

12 Claims, 2 Drawing Sheets

MAZE PUZZLE

BACKGROUND TO THE INVENTION

The present invention relates to a toy or plaything and more particularly to a toy or plaything in the form of a manually operable puzzle device.

A large number of puzzle devices have been proposed previously and the present invention seeks to provide a further such device which will capture the interest of a player and provide an intellectually stimulating challenge.

BRIEF SUMMARY OF THE INVENTION

According to the present invention there is provided a puzzle device, said device comprising a first spherical member, a second member constituting a housing within which said first member is rotatably mounted, said second member providing access to said first member to enable manual rotation thereof, there being a peg mounted on one of said first or second members and a maze defined in a surface of the other of the first and second members, the peg engaging the maze, the arrangement being such that upon selectively rotating said first member within said second member said peg is caused to move through said maze, there being further provided means to indicate when the peg is at a predetermined destination in the maze.

It should be appreciated that the word peg is used very broadly and is intended to cover any form of projection which could engage the maze.

Preferably said maze comprises a plurality of regions, between a start point of the maze and said predetermined destination, each region being connected to a successive region by a single, distinguishable path within the maze.

Conveniently said peg is biassed towards said first member so as to be received within the maze, the peg being movable against said bias in order to disengage the peg from the maze, thereby allowing unrestricted movement of the first member within the second member.

Advantageously said peg constitutes said indicating means, there being provided a bore within said maze at said predetermined destination, the arrangement being such that when the peg is aligned with the predetermined destination the peg will drop into the bore under said bias.

Alternatively said indicating means may be in the form of a light source, which is visible when the peg is at said predetermined destination.

Preferably in said alternative embodiment said light source is located within said first member, the first member being substantially opaque and being provided with a region through which light may pass.

Conveniently in this embodiment said second member is substantially opaque and is provided with a region through which said light may pass freely when said first and second members are aligned in positions where the peg is at said predetermined destination. The second member may be formed from a substantially opaque material through which some light may pass, such that light passing through said region in the first member may be observed through the second member by a player playing with the puzzle device.

Advantageously said maze is defined by the outer surface of said first member and said peg is mounted upon the second member.

Preferably said first member is of spherical configuration and said second member is in the form of a hollow, spherical shell surrounding the first member, an aperture being provided through said shell to provide access to the first member.

Conveniently said maze has a predetermined start point and means are provided for indicating when the peg is at the predetermined start of the maze.

The means to indicate when the peg is at the start of the maze may comprise a marking present on the first member visible through an aperture in the second member.

INTRODUCTION TO THE DRAWINGS

In order that the present invention may be more readily understood and so that further features thereof may be appreciated, the invention will now be described by way of example, with reference to the accompanying drawings, in which.

DESCRIPTION OF PREFERRED EMBODIMENT

Figure 1:
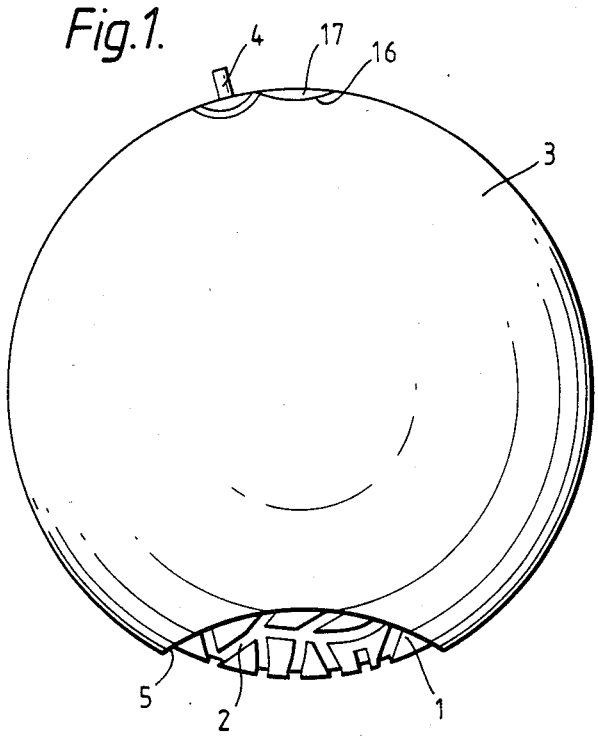
FIG. 1 is a side view of a puzzle device in accordance with the present invention.

Referring to the drawings, FIG. 1 illustrates a puzzle device comprising an inner sphere 1 provided on its outer surface with a maze 2, formed by a plurality of tracks or paths recessed into the surface of the sphere, the inner sphere 1 being rotatably mounted within an outer shell 3, which defines a part spherical chamber which receives the sphere 1. A peg 4 extends through the outer spherical shell 3 so that one end thereof is received within a track or path of the maze 2. The maze 2 has a predetermined start and finish. An aperture 5 is provided in the outer shell 3, thus providing access to the inner sphere 1 so that the inner sphere may be moved by hand within the outer shell 3 so as to guide the peg 4 through the maze 2 from the start to the predetermined finish or destination. Means are provided to indicate when the peg 4 has reached the finish of the maze 2. A player playing with the puzzle device does not know where the finish of the maze is located. There is a direct path leading from the start to the finish although there are numerous "blind alleys" provided in the maze. Thus, seeking to guide the peg 4 to the finish of the maze 2 provides an interesting and intellectually stimulating puzzle.

Figure 3:
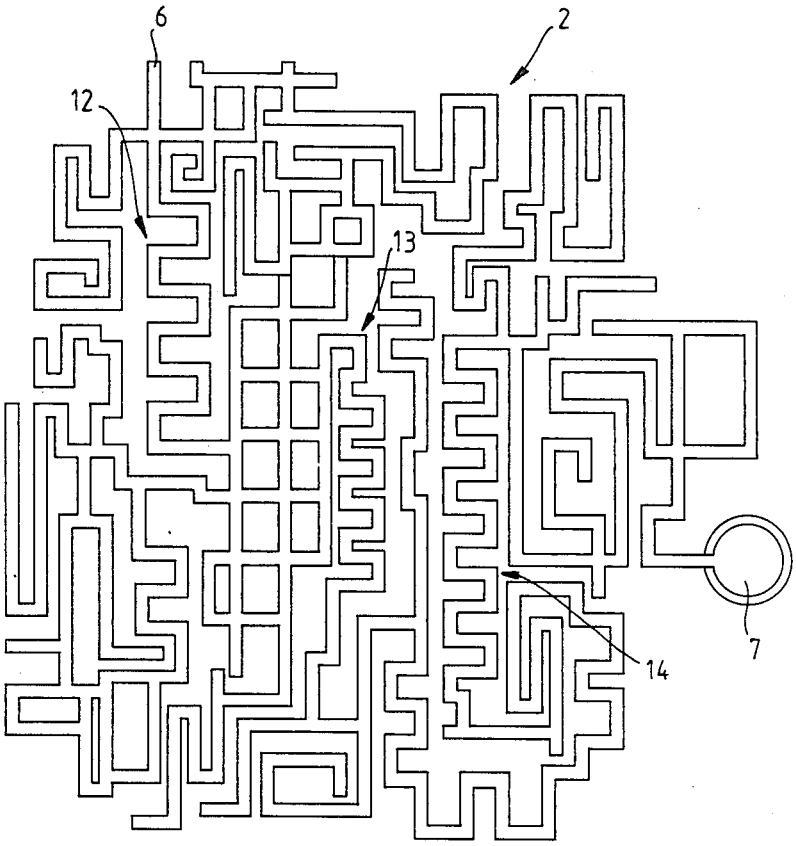
FIG. 3 illustrates an example of a maze provided on a component of the puzzle device of FIGS. 1 and 2 the figure being in flat projection of a maze formed on a spherical surface.
Figure 4:
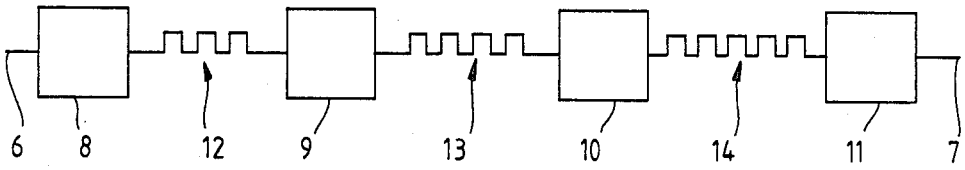
FIG. 4 is a block-type diagram illustrating the manner in which the maze of FIG. 3 is arranged.

The inner sphere 1 is a hollow component formed from a plastics material and defines the maze 2 on its outer surface. The sphere may be formed using a blow moulding technique, and thus a relatively cheap tool may be used. The maze 2 has a predetermined start point 6 and a predetermined finish 7 ( see FIG. 3). So that the puzzle is not one of total chance there is a logic involved in seeking the correct path between the start 6 and the finish 7. FIG. 4 illustrates, in block diagram form, the logic in the arrangement of the maze 2. The maze consists of a plurality of regions 8, 9, 10, 11, each region being interconnected to the next by a single, distinguishable path 12, 13, 14 within the maze. In FIG. 4 the start 6 of the maze is located at the left hand end of the diagram whilst the finish 7 is located at the right hand end of the diagram. The distinguishable paths 12, 13, 14 are also illustrated in FIG. 3. The region 8 of the maze provides at least one route between the start 6 and the first distinguishable path 12, but also includes numerous "blind alleys". The region 8 may provide more than one route between the start 6 and the first distinguishable path 12. The distinguishable path is formed by a track of a characteristic form, so that a person operating the puzzle finds that the sphere almost moves itself in a particular way as the peg passes along the track of predetermined form. Similarly the regions 9, 10 of the maze each provide at least one route between the first distinguishable path 12 and the second distinguishable path 13 and between the second distinguishable path 13 and the third distinguishable path 14 respectively. These regions also include numerous blind alleys and may include more than one route between the first and second and second and third distinguishable paths. Also the region 11 of the maze provides a route between the third distinguishable path 14 and the finish 7 along with numerous blind alleys. Again more than one route between the third distinguishable path 14 and the finish 7 may be provided within the region 11.

The distinguishable paths 12, 13, 14 each consist of a path of castellated arrangement, the number of castellations in each path increasing towards the finish 7 of the maze. Thus, the paths 12, 13, 14 form an identifiable sequence, and once a player has realised the logic involved in the maze he or she will be able to gain some idea of where the peg 4 is positioned within the maze relative to the finish when one of the distinguishable paths 12, 13, 14 is perceived during movement of the inner sphere 1. The distinguishable paths 12, 13, 14 may of course take any desired configuration so long as the paths define an identifiable sequence.

The inner sphere 1 is formed from an opaque material and is provided with a small aperture 15, the purpose of which will be explained hereinafter.

The outer shell 3 is a hollow shell formed in two halves which may be secured together by any appropriate means. The peg 4 is in the form of a cylindrical peg which extends through and is secured upon the outer shell 3. The depth of peg 4 extending through the shell 3 corresponds to the depth of the paths or tracks of the maze 2 formed on the outer surface of the inner sphere 1. The outer shell 3 has a cut away region to form the aperture 5 by way of which the inner sphere 1 may be rotated within the outer shell and is also provided with a region through which light may pass freely, without any reduction in intensity. This region may be a second, smaller aperture 16, located diametrically opposite the aperture 5. When the outer shell 3 is assembled the aperture 16 may be plugged with a transparent cover 17.

Means are provided within the puzzle to indicate when a player has successfully guided the peg 4 to the finish 7 of the maze. The indicating means are in the form of a light source 18 and an associated battery mounted within the inner sphere 1. The light source 18 may, for example, be in the form of a light emitting diode. A small battery may keep such a diode illuminated for many months. The light source 18 is located diametrically opposite the aperture 15, which is itself plugged with a transparent cover 19.

In order to assemble the puzzle the electrical circuit incorporating the light source 18 is passed through the aperture 15 into the inner sphere 1 and is mounted in position diametrically opposite the aperture 15. The light source 18 is intended to be permanently illuminated. The transparent cover 19 is then positioned within the aperture 15 in order to plug the bore. The outer shell 3 is assembled over the inner sphere 1 so that the lower end of the peg 4 extends into the maze defined on the outer surface of the inner sphere. The transparent cover 17 is then inserted into the aperture 16 adjacent the peg 4 in the outer shell 3.

Figure 2:
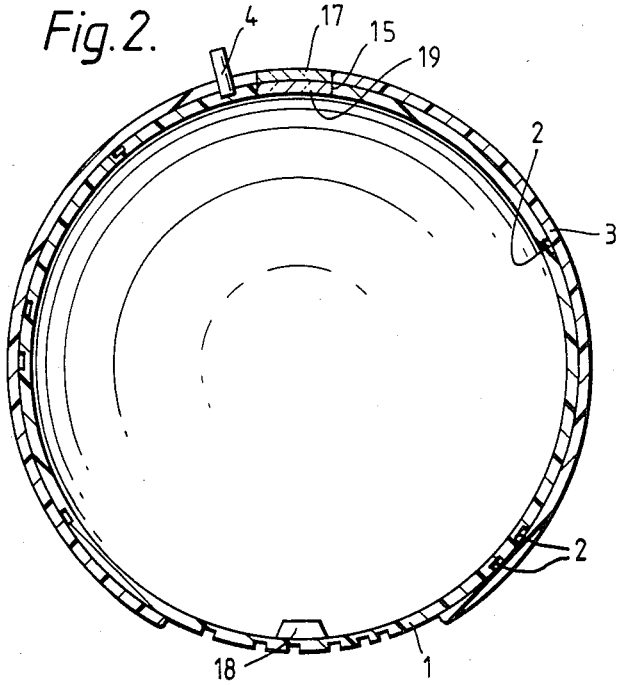
FIG. 2 is a cross-sectional view taken through the puzzle device shown in FIG. 1.

The material from which the outer shell 3 is formed is substantially opaque so that the player cannot see through the outer shell and thus cannot see the majority of the maze on the outer surface of the inner sphere 1. However, the outer shell 3 does allow light, such as light from the light emitting diode, passing through the transparent cover 19 to be observed by the player, although at a reduced intensity. The inner sphere and outer shell are assembled so that when the peg 4 is at the finish 7 of the maze the apertures 15, 16 in the inner sphere and the outer shell respectively are aligned, as illustrated in FIG. 2, so that light from the light source 18 will shine through the transparent covers 19, 17, thus indicating to the player that the finish 7 has been reached.

Thus, as well as the logic sequence described above the player is able to see a "spot" of light through the outer shell 3 and knows that this "spot" of light must be guided towards the cover 17. The puzzle could, of course, be made more difficult by forming the outer shell 3 from a non light-transmitting material so that the player would not be able to see light from the light source 18 until the two apertures 15, 16 are aligned and the finish has been reached.

In an alternative embodiment of the present invention the means for indicating when the finish 7 of the maze has been reached may be in the form of a spring biassed peg 4. Thus, the peg 4 may be spring biassed towards the inner sphere 1, there being provided a further small aperture or recess in the sphere at a position corresponding to the finish 7 of the maze. When the finish 7 is located adjacent the peg 4 the peg will drop into the aperture or recess under the action of the spring bias. The peg 4 would, of course, be provided with a collar or some other form of stop to prevent the peg from dropping into the inner sphere 1. The peg 4 could subsequently be pulled out of the inner sphere 1 against the spring bias so that the peg is totally disengaged from the maze, and the inner sphere 1 could then be moved unrestrictedly within the outer shell 3 in order to return the peg 4 to the start position in the maze. Means may be provided on the inner sphere 1 to indicate when the peg 4 is at the start 6 of the maze. Such means may be in the form of a marking, such as a coloured marking carried on the maze which marking would be visible through the aperture 5 in the outer shell.

Many existing puzzles suffer from the disadvantage that once they have been solved, they provide little challenge and therefore lose their attraction. Since the inner sphere 1 of the present puzzle is relatively cheap to produce, using a blow moulding technique, it is envisaged that puzzles having differing maze arrangements on the inner sphere 1 could be produced. The different inner spheres would have different logic systems in their mazes, so that when a person has realised the logic involved in one particular puzzle and is able to solve that puzzle relatively easily, they may purchase a new puzzle, having a different maze arrangement, which will provide a fresh challenge.

It will be appreciated that numerous modifications and alterations may be made to the above described embodiments of puzzle without departing from the scope of the present invention. It would, for example, be possible to provide an outer shell 3 which is of non-spherical configuration. It would also be possible to provide the maze 3 upon the internal surface of a spherical outer shell, with a radially outwardly directed peg being mounted upon an inner sphere. Numerous further modifications could, of course, be made. The peg could be any form of protrusion.

What is claimed is:

1. A puzzle device comprising a first member of spherical configuration and a second member constituting a housing within which said first member is rotatably mounted, said second member being constructed and arranged to surround said first member in such a manner that said first member is retained within said second member, an aperture through said second member to provide access to said first member to enable manual rotation thereof, a peg mounted on one of said members and a maze defined in a surface of the other of said first and second members, the peg and the maze being so constructed and arranged that the peg engages the maze, the construction and arrangement of the peg and the maze being such that upon selectively rotating said first member within said second member said peg is caused to move through said maze, and means to indicate when the peg is at a predetermined destination in the maze while said first member is retained within said second member.

2. A puzzle device according to claim 1, wherein said second member is constructed and arranged in the form of a hollow, spherical shell surrounding the first member.

3. A puzzle device according to claim 2 wherein said maze comprises a plurality of regions, between a start point of the maze and said predetermined destination each region being connected to a successive region by a single, distinguishable path within the maze.

4. A puzzle device according to claim 2, wherein said peg is biassed towards said first member so as to be received within the maze, the peg being movable against said bias in order to disengage the peg from the maze, thereby allowing unrestricted movement of the first member within the second member.

5. A puzzle device according to claim 4, wherein said peg constitutes said indicating means, there being provided a bore within said maze at said predetermined destination, the arrangement being such that when the peg is aligned with the predetermined destination the peg will drop into the bore under said bias.

6. A puzzle device according to claim 2, wherein said indicating means are in the form of a light source, which is visible when the peg is at said predetermined destination.

7. A puzzle device according to claim 6, wherein said light source is located within said first member, the first member being substantially opaque and being provided with a region through which light may pass.

8. A puzzle device according to claim 7, wherein said second member is substantially opaque and is provided with a region through which said light may pass freely when said first and second members are aligned in positions where the peg is at said predetermined destination.

9. A puzzle device according to claim 7, wherein said second member is formed from a substantially opaque material through which some light may pass, such that light passing through said region in the first member may be observed through the second member by a player playing with the puzzle device.

10. A puzzle device according to claim 2, wherein said maze is defined by the outer surface of said first member and said peg is mounted upon the second member.

11. A puzzle device according to claim 2, wherein said maze has a predetermined start point and means are provided for indicating when the peg is at the predetermined start of the maze.

12. A puzzle device according to claim 11 wherein the means to indicate when the peg is at the start of the maze comprises a marking present on the first member visible through an aperture in the second member.

* * * * *